US010995518B2

(12) United States Patent
Crandall et al.

(10) Patent No.: US 10,995,518 B2
(45) Date of Patent: May 4, 2021

(54) FENCE BRACE SYSTEM

(71) Applicants: Fonda Crandall, Reno, NV (US); Joseph Crandall, Reno, NV (US)

(72) Inventors: Fonda Crandall, Reno, NV (US); Joseph Crandall, Reno, NV (US)

( * ) Notice: Subject to any disclaimer, the term of this patent is extended or adjusted under 35 U.S.C. 154(b) by 0 days.

(21) Appl. No.: 16/881,653

(22) Filed: May 22, 2020

(65) Prior Publication Data

US 2020/0284062 A1 Sep. 10, 2020

Related U.S. Application Data

(60) Division of application No. 16/517,584, filed on Jul. 20, 2019, now Pat. No. 10,697,198, which is a continuation-in-part of application No. 15/856,741, filed on Dec. 28, 2017, now Pat. No. 10,597,898, which is a division of application No. 14/863,793, filed on Sep. 24, 2015, now Pat. No. 10,030,408.

(51) Int. Cl.
*E04H 17/14* (2006.01)

(52) U.S. Cl.
CPC ..... *E04H 17/1417* (2013.01); *E04H 17/1447* (2021.01); *E04H 17/1452* (2021.01); *E04H 17/1473* (2021.01); *E04H 17/1482* (2021.01)

(58) Field of Classification Search
CPC ..... E04H 17/1413; E04H 17/1417; E04H 17/1426; E04H 17/143; E04H 17/1439; E04H 17/1447; E04H 17/1482; E04H 17/1473
See application file for complete search history.

(56) References Cited

U.S. PATENT DOCUMENTS

| | | | | |
|---|---|---|---|---|
| 4,526,348 A * | 7/1985 | Cammack | F16B 7/0486 256/65.06 |
| 5,403,110 A * | 4/1995 | Sammann | F16B 7/0486 403/234 |
| 6,290,214 B1 * | 9/2001 | DeSouza | E04H 17/1413 256/69 |
| 7,398,621 B2 * | 7/2008 | Banta | E04B 1/2608 52/93.1 |
| 2014/0223745 A1 * | 8/2014 | Eberhart | F16B 7/0493 29/897.31 |

FOREIGN PATENT DOCUMENTS

| | | | | |
|---|---|---|---|---|
| GB | 275371 | * | 8/1927 | E04H 17/1413 |
| GB | 677092 | * | 8/1952 | E04H 17/1413 |

* cited by examiner

*Primary Examiner* — Michael P Ferguson

(57) ABSTRACT

The present invention comprises a brace adapted to secure one or more fence rails to a fence post. The present invention brace may optionally be installed onto an existing fence or on a new fence. The invention includes a fence post brace member adapted to connect to one or more sides of a fence post and a fence rail brace member adapted to connect to two or more sides of a fence rail. The fence post brace member may form a vertical picket fastener slot for use in affixing a picket to the fence post. The fence post brace system may be adapted for use with alternative fence post arrangements such as those having a fence rail positioned above and supported by the fence post and those defining a single channel for receiving a fence rail.

5 Claims, 7 Drawing Sheets

FENCE BRACE SYSTEM

CROSS-REFERENCES TO RELATED APPLICATIONS

This non-provisional utility application is a divisional application of the pending continuation-in-part (CIP) U.S. application Ser. No. 16/517,584 filed on Jul. 20, 2019 titled "Fence Brace System" and of the U.S. Pat. No. 10,597,898 (application Ser. No. 15/856,741) titled "Fence Brace System" filed on Dec. 28, 2017 and U.S. Pat. No. 10,030,408 (application Ser. No. 14/863,793) titled "Fence Brace System" originally filed on Sep. 24, 2015, which are hereby incorporated in their entirety by reference.

BRIEF DESCRIPTION OF THE INVENTION

The present invention relates to the field of fences. More particularly, the present invention relates to a system for providing structural support for fences including for fences having alternative fence post arrangements including fence arrangements wherein the fence rail is positioned above the fence post and wherein a fence rail is attached to only a first side of the fence post.

The present invention provides strength for building a new fence or repairing an existing fence. The fence would not need to be removed or modified to install the herein disclosed brace. Installation would be simple. The brace could be mass produced at low cost. The color and style of the brace could be easily adapted to match aesthetically with the fence and the surrounding area. The brace itself may be painted, stained, powder coated, colored, or made with a colored metal. The brace may also be built into a new fence. The present invention optionally includes embodiments adapted for fences with rectanguloid rails or for rectanguloid fence posts. The present invention may be optionally optimized for a fence with cylindrical fence posts. The brace may be made of strong weather-resistant material such as steel, stainless steel, galvanized steel, aluminum, plastic, graphite, wood, or any composite material(s).

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

Fence and fence structure are subject to damage due to high winds, torrential rains, heavy snowfall, vehicular accidents, termites, vandalism, earthquakes and falling trees and branches. The most common of these causes is high winds. Wind damages fences all around the world every year. Fences made of wood are especially susceptible to wind damage because wood is weakened by prolonged exposure to rain, snow, wind, and other elements. Despite the potential for damage, wood is still by far the most common residential fencing material in the United States. In 2007 alone, Americans put up 59,000 miles of wood fencing, enough to circle the globe twice. Wood is inexpensive and lightweight, and a wood fence can easily be shaped to give properties character and individuality. There are many styles, including linear post-and-rail and crisscrossing lattice, as well as myriad picket patterns and post-cap designs. And the wood may be painted or stained to match almost any landscape.

Fences could be built much stronger through the use of heavy materials such as steel and sturdy construction. However, this might drive the costs of the fence up above what is acceptable. As well, there are the aesthetic considerations discussed above. Also, it is unlikely that a property owner would replace an existing fence merely because of the possibility that it could be damaged by the elements.

There is an unmet need, therefore, for an inexpensive way to provide a fence with additional structural support. The need is especially great with respect to existing fences and with respect to wooden fences.

DETAILED DESCRIPTION OF THE INVENTION

Figure 2:
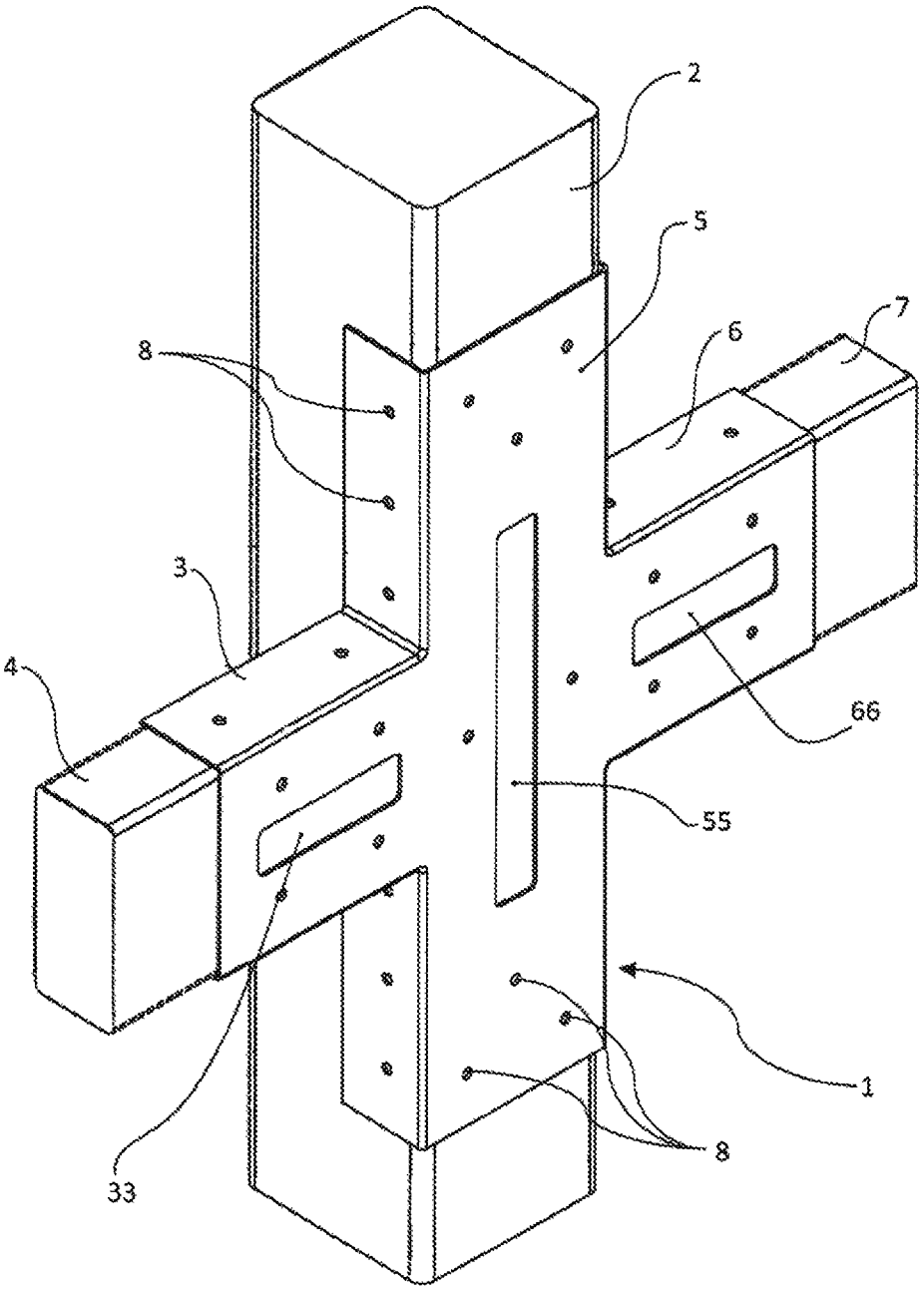
FIG. 2 illustrates an isometric view of an embodiment of a fence brace, in accordance with the present invention.

In a preferred embodiment as illustrated in FIG. 2, the present invention comprises fence brace 1 for securing at least one fence rail 4 to fence post 2 including first fence rail brace member 3 adapted to connect to two or more sides of first fence rail 4. First fence rail brace member 3 may be fused to a first side of fence post brace member 5 wherein fence post brace member 5 is adapted to connect to two or more sides of fence post 2. The fence rail may be rectanguloid. As used herein, the term "rectanguloid" means a solid (3-dimentional) object which has six faces that are rectangles. It has the same cross-section along a length. As used herein, "rectanguloid" is the same as a rectangular prism. A rectanguloid may be though of as a 3-dimentional version of a rectangle or a square. The herein disclosed fence brace system may further include second fence rail brace member 6 fused to a second side of fence post brace member 5, wherein second fence rail brace member 6 is adapted to connect to two or more sides of second fence rail 7.

Fence brace 1 may include plurality of holes 8 thereby allowing fence post brace member 5 to be securely fastened to fence post 2 and thereby allowing first fence rail brace member 3 to be securely fastened to first fence rail 4 and second fence rail brace member 7 to be securely fastened to second fence rail 7. The plurality of holes may be referred to as screw-holes, nail holes, bolt holes, or other fastener holes. The plurality of holes may each receive a screw, a nail, a bolt, or an alternative type of fastener for securely connecting fence brace 1 to the fence post and/or the fence rail(s). The various figures illustrate the plurality of holes positioned in exemplary locations; those skilled in the art will recognize that the plurality of holes may be formed in various locations on the fence brace to provide the intended benefit of allowing secure attachment of the fence brace to the fence (the fence post and the fence rails).

Fence brace 1 may be formed of a strong weather-resistant material such as selected from the group consisting of steel, stainless steel, galvanized steel, aluminum, plastic, graphite, wood, or any composite material(s).

An embodiment of the present invention may further include one or more picket fastener slots for allowing one or more pickets (or boards) to be attached to the fence. For example, and as illustrated in FIG. 2 as a preferred embodiment, fence post brace member 5 forms vertical picket fastener slot 55, first fence rail brace member 3 forms first horizontal picket fastener slot 33, and second fence rail brace member 6 forms second horizontal picket fastener slot 66. This embodiment allows for attachment of a picket to fence post 2 through vertical picket fastener slot 55, attachment of a picket to first fence rail 4 through first horizontal picket fastener slot 33, and/or attachment of a picket to second fence rail 7 through second horizontal picket fastener slot 66. After fastening one or more pickets through the respective picket fastener slot, the herein disclosed fence brace is positioned in between the fence and the picket.

Figure 3:
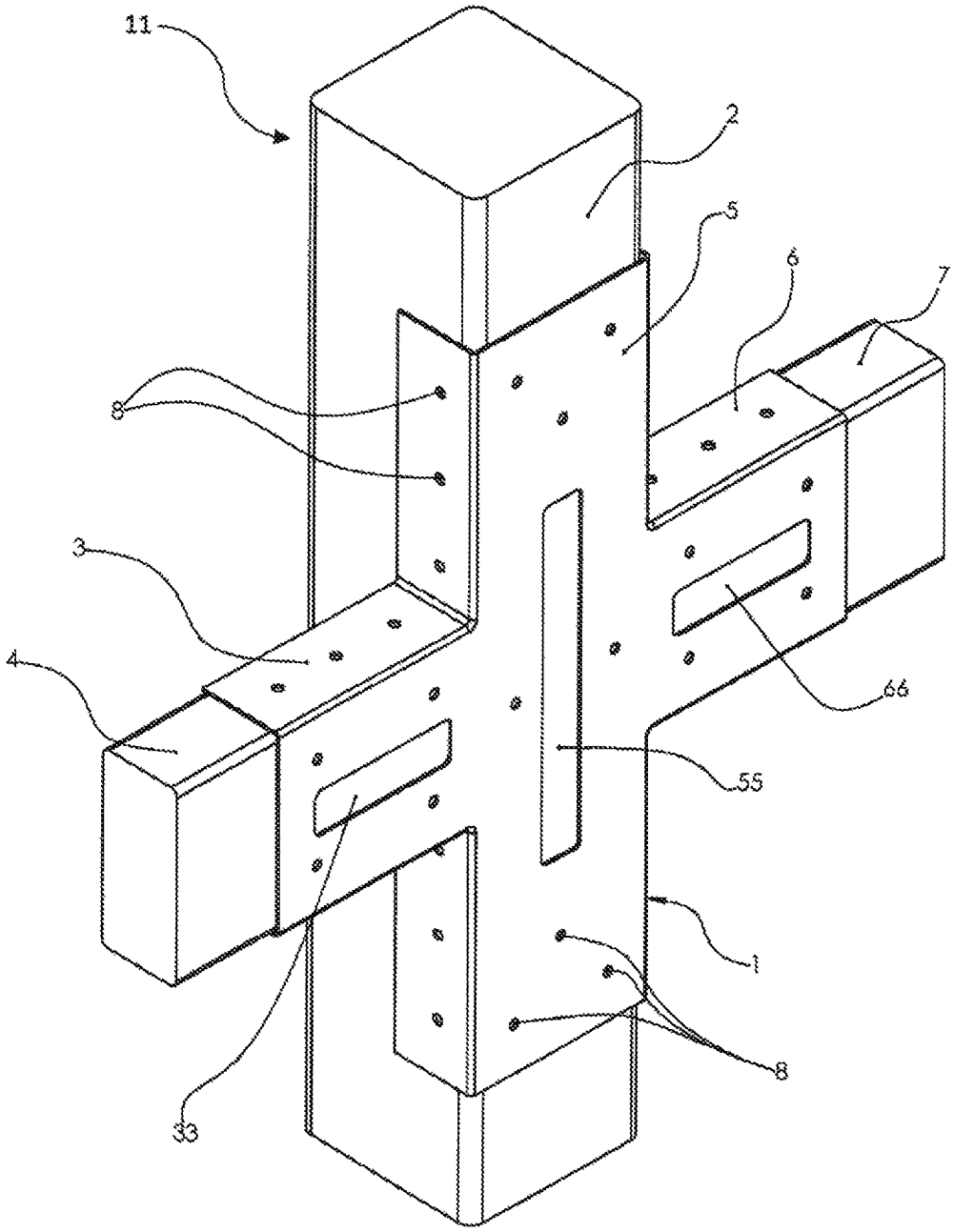
FIG. 3 illustrates an isometric view of an embodiment of a fence assembly including a fence brace, a fence post, and a plurality of linearly disposed fence rails in accordance with the present invention.

Referring to FIG. 3, an embodiment of a fence brace assembly is Illustrating comprising fence brace 1 attached to fence 11. Fence brace 1 includes fence post brace member 5 attached to fence post 2 and forming vertical picket fastener slot 55, first fence rail brace member 3 attached to first fence rail 4 and forming first horizontal picket fastener slot 33, and second fence brace member 6 attached to second fence rail 7 and forming second horizontal picket fastener slot 66.

Throughout this specification the fence brace system is mostly described as including a fence post brace member, a first fence rail brace member, and a second fence rail brace member. But for the present invention, fence post brace member 5 may alternatively be referred to as a pair of opposing upper and lower fence post flanges, each of the fence post flanges comprising a planer central wall and a pair of rearward-protruding side walls extending along opposing vertical longitudinally-extending edges of the central wall, the sidewalls of the upper fence post flange being vertically-aligned with the sidewalls of the lower fence post flange to define a pair of aligned channels for receiving the fence post therein. First fence rail brace member 3 and second fence rail brace member 6 may alternatively be referred to as a pair of opposing left and right fence rail flanges, each of the fence rail flanges comprising a planar central wall and a pair of rearward-protruding side walls extending along opposing horizontal longitudinally-extending edges of the central wall, the sidewalls of the left fence rail flange being horizontally-aligned with the sidewalls of the right fence rail flange to define a pair of aligned channels for receiving the fence rails therein.

Figure 1:
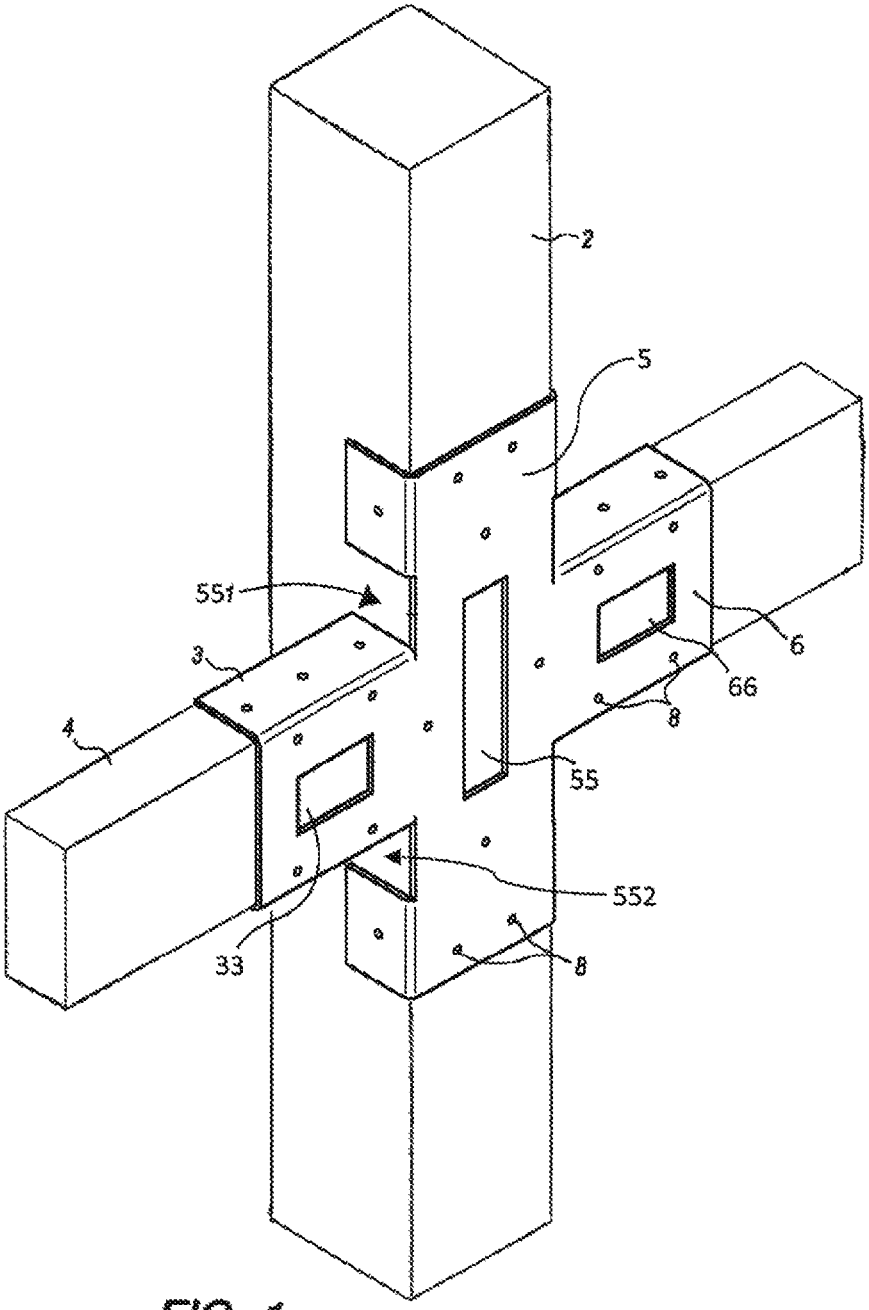
FIG. 1 illustrates an isometric view of an embodiment of a fence brace, wherein one or more cutouts are formed by the fence brace, in accordance with the present invention.

Referring to FIG. 1, an alternative embodiment of the herein disclosed fence brace system is illustrated wherein the rearward-protruding side walls of the opposing upper and lower fence post flanges do not extend all the way to the first and second fence rails. In this embodiment illustrated in FIG. 1, an upper flange cutout 551 is formed on each side of the upper flange and a lower flange cutout 552 is formed on each side of the lower flange. The embodiment illustrated in FIG. 2 differs in that the pair of rearward-protruding side walls extend fully towards first fence rail brace member and the second fence rail brace member so that the entire edge of the fence post (or a larger portion of the edge of the fence post) is covered by the rearward-protruding side walls.

Figure 4:
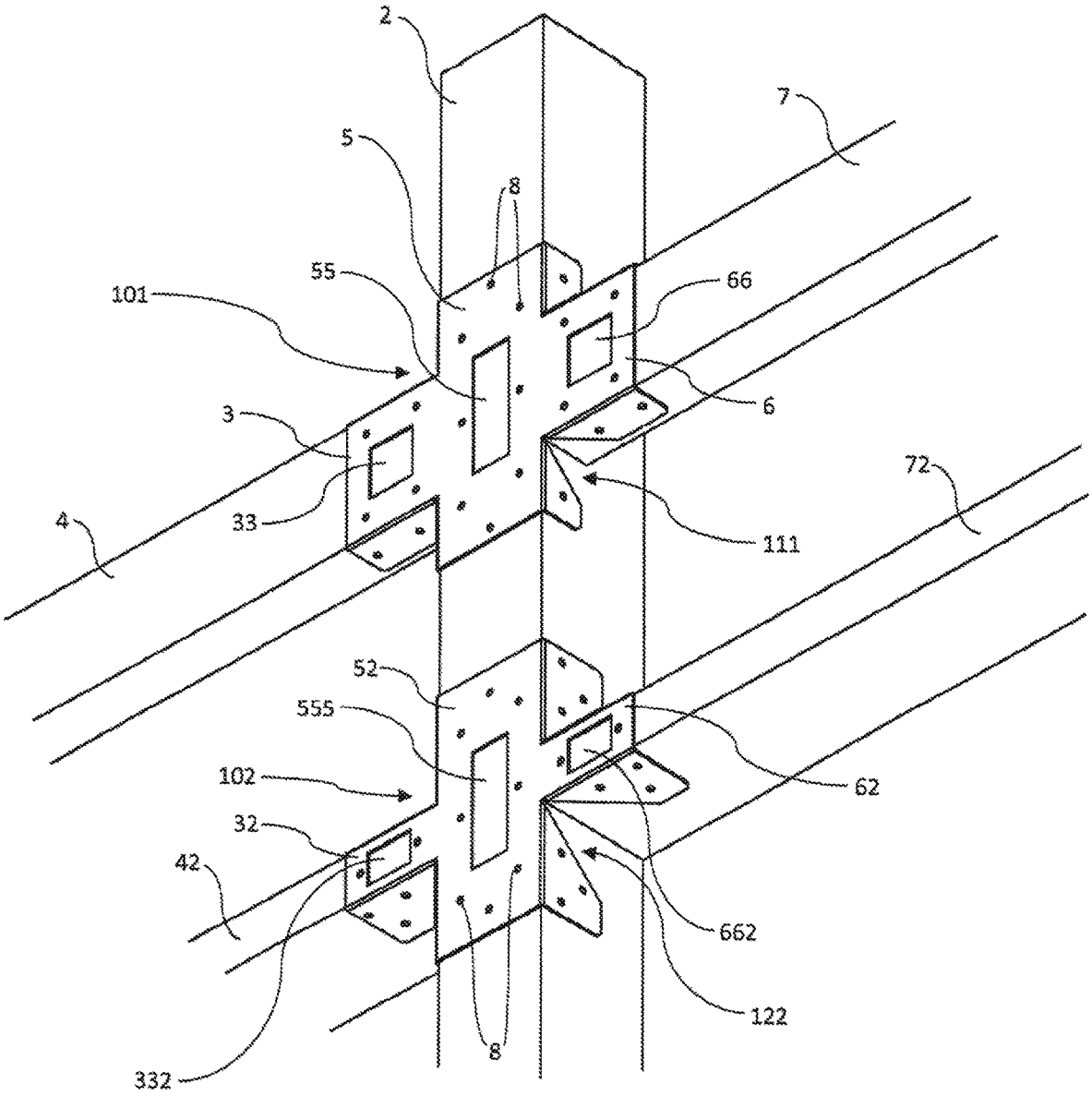
FIG. 4 illustrates an isometric view of two alternative embodiments of a fence assembly including a fence brace, a fence post, and a plurality of linearly disposed fence rails in accordance with the present invention, wherein the fence brace includes one or more angled or slanted edges formed by the rearward-protruding sidewalls.
Figure 5:
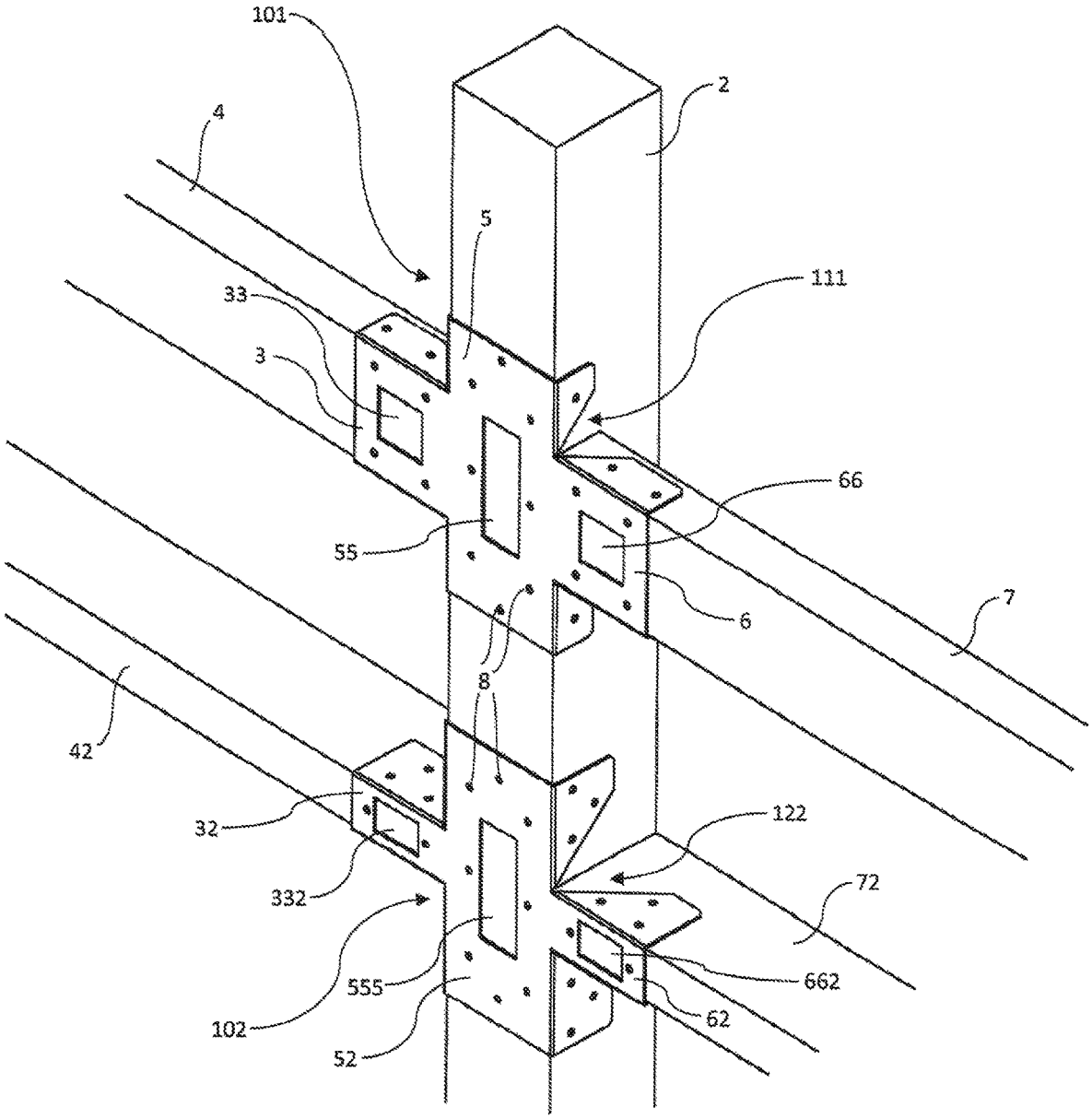
FIG. 5 illustrates an isometric view, from an alternative viewing angle, of two alternative embodiments of a fence assembly including a fence brace, a fence post, and a plurality of linearly disposed fence rails in accordance with the present invention, wherein the fence brace includes one or more angled or slanted edges formed by the rearward-protruding sidewalls.

Referring to FIG. 4 and FIG. 5, additional alternative embodiments of the herein disclosed fence brace system are shown that differ from the embodiment depicted in FIG. 1 by having one or more angled or slanted edges formed by the rearward-protruding sidewalls. In these alternative embodiments, one or more v-shaped cutouts may be formed by the rearward-protruding sidewalls.

Fence brace member 101 is adapted for use with first vertically oriented fence rail 4 and second vertically oriented fence rail 7. Fence rail 4 and fence rail 7 are referred to as vertically oriented because the respective fence rails are positioned so that they are taller than they are wide. Fence brace member 101 may include first fence rail brace member 3 forming first horizontal picket fastener slot 33, second fence rail brace member 6 forming second horizontal picket fastener slot 66, fence post brace member 5 forming vertical pocket fastener slot 55, one or more fastener holes 8, and may form one or more v-shaped cutout 111. V-shaped cutout 111 may be formed at one or more corners of fence brace member 101; in a preferred embodiment, v-shaped cutout 111 is formed at each of the four corners of fence brace member 101.

Fence brace member 102 is adapted for use with first horizontally oriented fence rail 42 and second horizontally oriented fence rail 72. Fence rail 42 and fence rail 72 are referred to as horizontally oriented because the respective fence rails are positioned so that they are wider than they are tall. Fence brace member 102 may include first fence rail brace member 32 forming first horizontal picket fastener slot 332, second fence rail brace member 62 forming second horizontal picket fastener slot 662, fence post brace member 52 forming vertical pocket fastener slot 555, one or more fastener holes 8, and may form one or more v-shaped cutout 122. V-shaped cutout 122 may be formed at one or more corners of fence brace member 102; in a preferred embodiment, v-shaped cutout 122 is formed at each of the four corners of fence brace member 102.

Figure 6:
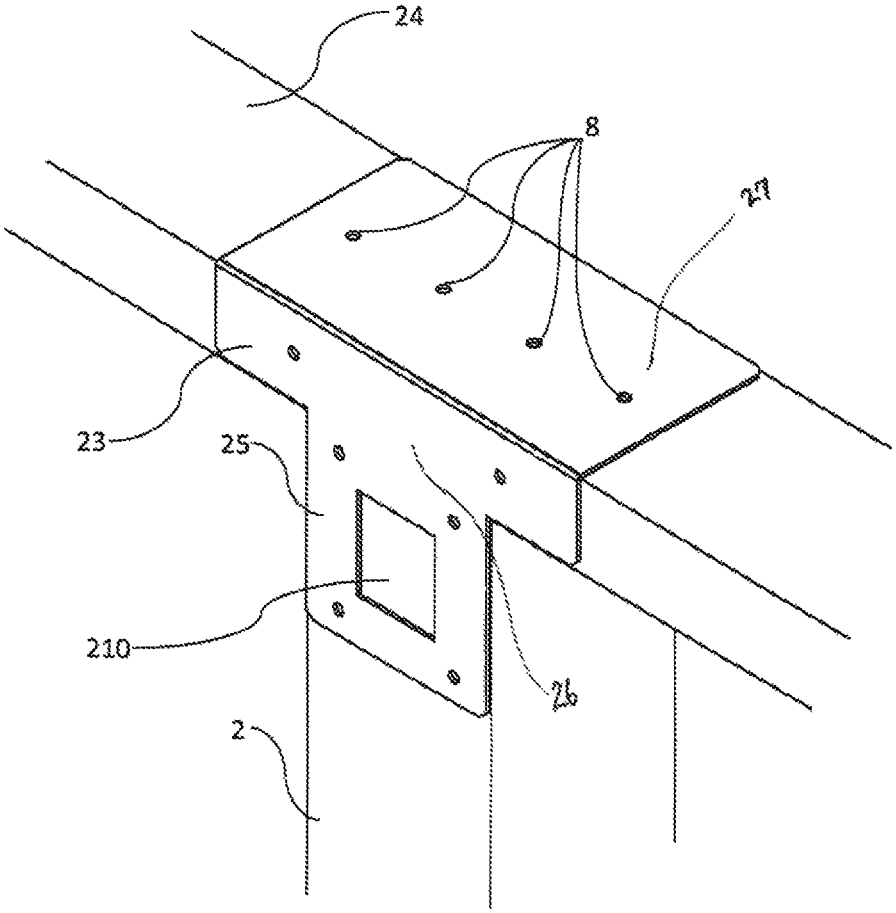
FIG. 6 illustrates an isometric view of an alternative embodiment of a fence assembly adapted for use with one or more fence rails positioned above the fence post so that the fence rail is supported by the fence post and may extend continuously above and past the fence post in accordance with the present invention.
Figure 7:
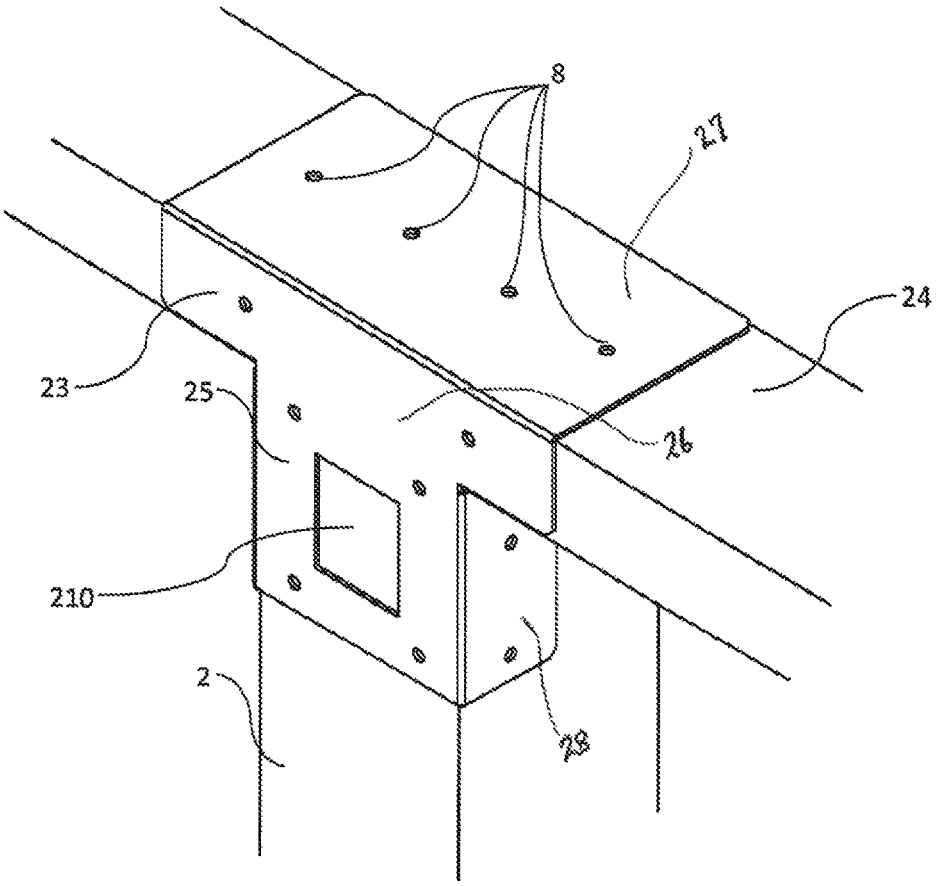
FIG. 7 illustrates an isometric view of a differing alternative embodiment of a fence assembly adapted for use with one or more fence rails positioned above the fence post so that the fence rail is supported by the fence post and may extend continuously above and past the fence post in accordance with the present invention.

Referring to FIG. 6 through FIG. 7, alternative embodiments of the herein disclosed fence assembly are shown from various viewing angles that are adapted for use with one or more fence rails 24 positioned above and supported by fence post 2 so that the fence rail may extend horizontally past fence post 2. These alternative embodiments may include: fence post 2 having a rectangular cross-section;

fence rail 24 having a rectangular cross-section and positioned above and supported by fence post 2; a fence post brace member 25 forming a picket fastener slot 210 for receiving a fastener therethrough to affix a picket to fence post 2 with the fence post brace member 25 therebetween; and fence rail brace member 23 having a flange comprising a planar central wall 26 and a rearward-protruding wall 28 extending along a horizontal longitudinally-extending edge of the central wall 27, the wall of the fence rail flange defining a channel for receiving fence rail 24 therein. A plurality of fastener holes 8 may be disposed within, or formed by, the central wall 27 and the rearward-protruding wall 28 of the fence rail flange for receiving fasteners to secure fence rail 24 therein. Picket fastener slot 210 may be formed by fence post brace member 25 for receiving a fastener therethrough to affix a picket to fence post 2.

Fence post brace member 25 and fence rail brace member 23 may be formed of any material sufficiently rigid so as to provide adequate support to fence post 2—fence rail 24 connection. In a preferred embodiment, fence post brace member 25 and fence rail brace member 23 are made of steel, stainless steel, galvanized steel, aluminum, plastic, graphite, or any composite material(s).

Referring specifically to FIG. 6 through FIG. 7, fence post brace member 25 forms first picket fastener slot 210. Looking to FIG. 7, fence post brace member 25 may have rearward-protruding walls 28 defining a channel for receiving fence post 2, though other embodiments (see FIG. 6) may not utilize rearward-protruding walls 28 on fence post brace member 25. Fence rail flange 23 forms a plurality of fastener holes 8 for receiving one or more fasteners to secure the fence brace to fence rail 24. Fence rail flange 23 includes a rearward-protruding wall 28 that defines on two sides a channel for receiving fence post 2. In certain embodiments, picket fastener slot 210 may extend longitudinally through fence post brace member 25 and beyond a point defined by an extended edge of fence rail flange 23.

While the present invention has been illustrated and described herein in terms of a preferred embodiment and several alternatives, it is to be understood that the devices, systems, and assemblies described herein can have a multitude of additional uses and applications. Accordingly, the invention should not be limited to just the particular description and various drawing figures contained in this specification that merely illustrate a preferred embodiment and application of the principles of the invention.

What is claimed is:

1. A fence assembly comprising:

a fence post having a rectangular cross-section;

a fence rail having a rectangular cross-section and positioned above and supported by the fence post; and a fence brace formed from a single piece of material comprising:

a fence rail brace member comprising a planar central wall and a rearward-protruding sidewall bent rearward from and extending along a horizontal longitudinally-extending upper edge of the central wall, the central wall and the rearward-protruding sidewall of the fence rail brace member defining a fence rail channel for receiving the fence rail therein, and a plurality of fastener holes disposed within the planar central wall and rearward-protruding sidewall of the fence rail brace member for receiving fasteners to secure the fence rail therewith; and a fence post brace member comprising a central wall and a pair of rearward-protruding sidewalls each bent rearward from and extending along opposing vertical longitudinally-extending edges of the central wall, the fence post brace member central wall being coplanar with the fence rail brace member central wall and extending from a mid-point of a horizontal longitudinally-extending lower edge thereof opposite the upper edge, the rearward-protruding sidewalls of the fence post brace member defining a fence post channel for receiving the fence post therein, edges of the rearward-protruding sidewalls of the fence post brace member extending rearward from the lower edge opposite the fence rail brace member rearward-protruding sidewall to define the fence rail channel therebetween, and a plurality of fastener holes disposed within the central wall and rearward-protruding sidewalls of the fence post brace member for receiving fasteners to secure the fence post therewith; and a vertical picket fastener slot which longitudinally-extends through the fence post brace member central wall adjacent the lower edge of the fence rail brace member for receiving a fastener therethrough to affix a picket to the fence post with the fence post brace member therebetween.

2. The fence assembly of claim 1, wherein the fence brace is made of a material selected from the group consisting of steel, stainless steel, galvanized steel, aluminum, plastic, graphite, and a composite material.

3. The fence assembly of claim 1, further comprising at least one picket, wherein the picket is fastened to the fence post by passing a fastener through the picket and through the picket fastener slot and into the fence post.

4. The fence assembly of claim 1, wherein the fence rail is horizontally-oriented.

5. The fence assembly of claim 1, wherein the fence post is vertically-oriented.

* * * * *